United States Patent [19]

Gray et al.

[11] Patent Number: 4,698,080

[45] Date of Patent: Oct. 6, 1987

[54] FEED CONTROL FOR CRYOGENIC GAS PLANT

[75] Inventors: Michael L. Gray; Kristie C. Gibson, both of Bartlesville, Okla.

[73] Assignee: Phillips Petroleum Company, Bartlesville, Okla.

[21] Appl. No.: 866,022

[22] Filed: May 21, 1986

Related U.S. Application Data

[63] Continuation-in-part of Ser. No. 621,336, Jun. 15, 1984, abandoned.

[51] Int. Cl.[4] ..... F25J 3/00

[52] U.S. Cl. ..... 62/21; 62/37; 62/175; 62/228.3

[58] Field of Search ..... 62/9, 11, 21, 23, 36, 62/37, 40, 132, 226, 228.1, 228.3, 175

[56] References Cited

U.S. PATENT DOCUMENTS

| | | | |
|---|---|---|---|
| 3,411,308 | 11/1968 | Bellinger | 62/37 |
| 4,172,711 | 10/1979 | Bailey | 62/21 |
| 4,377,402 | 3/1983 | Crowe et al. | 62/35 |

*Primary Examiner*—Ronald C. Capossela
*Attorney, Agent, or Firm*—French and Doescher

[57] ABSTRACT

Overloading of a plurality of turbine drivers driving compressors in a plurality of compression cycles, such as the compression of refrigerants and the compression of normally gaseous feed in a method for cryogenically cooling such normally gaseous feed, due to changes in compressor limiting operating conditions, is prevented by measuring the suction pressures to the low pressure stages of the compressors, deriving a desired feed flow rate in response to each of such measured suction pressures, selecting the lowest desired feed flow rate (which will be derived in response to the highest measured suction pressure if all set points are equal), and adjusting the feed gas flow rate in response to the lowest flow rate. In a preferred embodiment, a manual set point representing a maximum feed gas flow rate is also applied and the selected feed rate is dictated by the highest suction pressure or the maximum feed rate, whichever is lower, and is utilized to adjust the feed rate. In another embodiment, the speeds of the individual turbine drivers are controlled in response to the low stage suction pressures to each of the individual turbine drivers.

13 Claims, 1 Drawing Figure

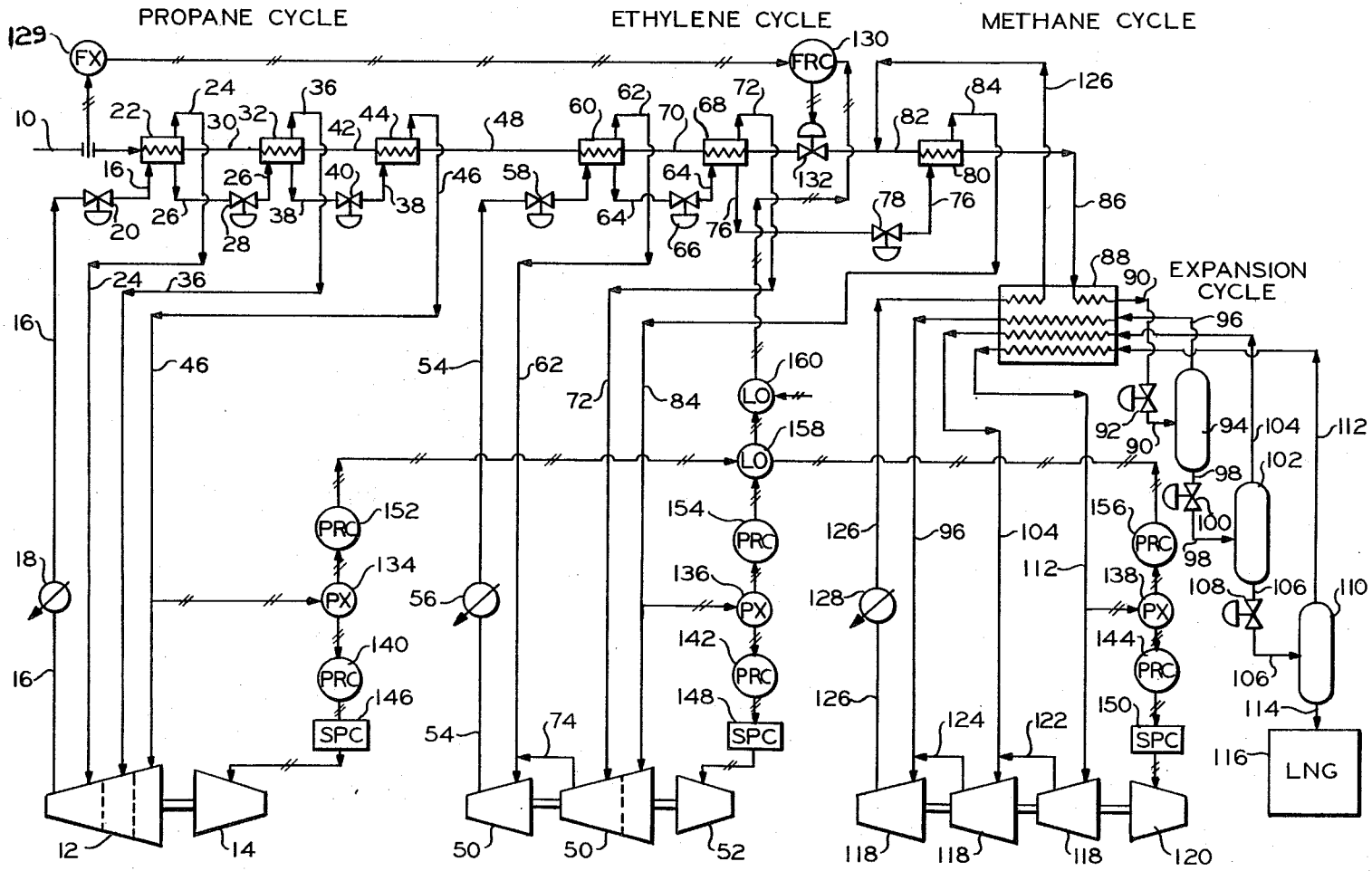
PROPANE CYCLE
ETHYLENE CYCLE
METHANE CYCLE
EXPANSION CYCLE
LNG
FX
FRC
LO
PRC
PX
SPC

FEED CONTROL FOR CRYOGENIC GAS PLANT

This application is a continuation-in-part of application Ser. No. 621,336, filed June 15, 1984 by the same inventors, now abandoned.

The present invention relates to a method of turbine drivers in a cryogenic gas plant and in a more specific aspect, the present invention relates to a method of controlling turbine drives in a liquefied natural gas plant.

BACKGROUND

Cryogenic liquefaction of normally gaseous materials is utilized for purposes of separation of mixtures, purification of the component gases, storage and transportation in an economic and convenient form, etc. Most such liquefaction systems have many operations in common, regardless of the gases involved, and, consequently, have many of the same problems. One common operation and its attendant problems is the compression of refrigerants and/or components of the gas. Accordingly, the present invention will be described with specific reference to processing natural gas but is applicable to other gas systems.

It is common practice in the art of processing natural gas to subject the gas to cryogenic treatment to separate hydrocarbons having a molecular weight higher than methane ($C_2+$) from the natural gas to thereby produce a pipeline gas predominating in methane and a $C_2+$ stream for other uses, usually involving first separating this fraction into individual components, for example, $C_2$, $C_3$, $C_5$ and $C_5+$. It is also common practice to cryogenically treat natural gas to liquefy the same for transport and storage.

Such cryogenic plants have a variety of forms, the most efficient and effective being a cascade-type operation and this type in combination with expansion-type cooling. Also, since methods for the production of liquefied natural gas (LNG) include the separation of hydrocarbons of higher molecular weight than methane as a first part thereof, a description of a plant for the cryogenic production of LNG effectively describes a similar plant for removing $C_2+$ hydrocarbons from a natural gas stream.

In the cascade-type of cryogenic production of LNG, the natural gas is first subjected to preliminary treatments to remove acid gases and moisture. The natural gas at an elevated pressure, either as produced from the wells or after compression and at approximately atmospheric temperature, is cooled in a plurality of multistage (for example, three) cycles by indirect heat exchange with a plurality of refrigerants. For example, the gas is sequentially passed through a plurality of stages of a first cycle utilizing a relatively high boiling refrigerant, such as propane, and thereafter through a plurality of stages of a second cycle in heat exchange with a refrigerant having a lower boiling point, for example, ethane or ethylene. This sequential cooling of the natural gas is also controlled in a manner to remove as much as possible of the $C_2$ and higher molecular weight hydrocarbons from the gas to produce a gas predominating in methane and containing small amounts of ethane. The $C_2+$ hydrocarbons are then usually further processed, as by fractionation in one or more fractionation zones, to produce individual components such as $C_2$, $C_3$, $C_4$ and $C_5+$. In the last stage of the second cooling cycle the main gas stream predominating in methane will generally be liquefied at essentially the pressure of the original feed gas. The liquefied main gas stream is then further cooled in indirect heat exchange with flashed gases, hereinafter described. Following this third cooling step nitrogen, if significant amounts thereof are present in a natural gas, is separated from the liquefied gas by fractionation or expansion and separation of the flashed gases to separate a gaseous methane stream containing most of the nitrogen. In a combined operation, after the nitrogen removal, the liquefied gas is further cooled in a fourth step or cycle comprising multiple stages of expansion and separation of flashed gas. Gases flashed or fractionated in the nitrogen separation step and those flashed in the expansion-flash step are utilized in the third cooling step referred to above. In each stage of the first and second cooling stages the gas is cooled by compressing the refrigerant to a pressure at which it can be liquefied by cooling. The liquefied refrigerant is then expanded to flash a portion thereof and the mixture of gas and liquid is passed to a chiller through which the feed gas stream passes in indirect heat exchange. The chiller often also functions as a separator for separating the flashed gas from the remaining liquid. The remaining liquid is then further expanded to flash a second portion thereof in the second stage of the cooling cycle, again the liquid and gas are separated and the liquid is further expanded to flash the remainder thereof in the third stage of the refrigeration cycle. These stages for convenience are referred to as a high stage, an intermediate stage and a low stage. The flashed gas from the high stage are at the highest pressure and highest temperature, the flashed gas from the second chiller is at an intermediate pressure and temperature and the flashed gas from the third stage is at the lowest pressure and lowest temperature. The flashed gases are then sequentially fed to an appropriate compressor or compressors. The gas from the third stage of the refrigeration cycle, which is at the lowest pressure and lowest temperature, is compressed. This compressed gas is then combined with the gas from the second stage and further compressed and the thus compressed third and second stage gases are mixed with the first stage gas and further compressed. The compressed refrigerant is then reused in the refrigeration cycle. The gases flashed in the expansion-separation cycle or fourth cooling cycle are compressed and recycled to the main feed gas stream. This compression of the flashed gases follows substantially the same procedure as that utilized in the compression of the refrigerants in the first two cycles. Specifically, if three stages of expansion-separation are utilized, the gas flashed in the first stage has the highest pressure and highest temperature, that flashed in the second stage an intermediate pressure and temperature and that flashed in the third or last stage has the lowest pressure and lowest temperature. Consequently, in compression of the flashed gases the gas flashed in the third stage, having the lowest pressure and temperature, is first compressed, then combined with the gas from the second stage, further compressed, and finally these two are combined with the gas from the first stage and still further compressed. In each of the separate compression cycles, i.e., the first refrigerant compression cycle, the second refrigerant compression cycle and the flashed gas compression cycle, a single turbine is utilized to drive one or more compressors.

Obviously, the refrigerant and flashed gas compressors have a design limit which should not be exceeded.

Obviously, overloading the compressors will result in undue wear or damage to the compressors. Unfortunately, there are a number of compressor limiting operating conditions which fluctuate and as a result tend to overload one or more of the compressors. Such flucutations include changes in inlet gas composition, changes in climate that affect turbine horsepower, changes in boil-off rates resulting from ship loading or non-ship loading operations, shutdown of a turbine (either planned or unplanned), if more than one is used in parallel operation, and changes in the operation of a fractionating unit or the like. While an individual turbine can be protected, as by a speed control or the like, this is not a complete answer since changes in the operation of one turbine will change the operation of the entire cryogenic system resulting in possible overloading of other compressors as well as failure to maintain balanced operating conditions through out the cryogenic system.

SUMMARY OF THE INVENTION

It is, therefore, an object of the present invention to provide an improved method of compressor control which overcomes the above and other problems of the prior art. A further object of the present invention is to provide an improved method for controlling the feed rate of a gas through a cryogenic cooling system which overcomes the above and other problems of the prior art. Another and further object of the present invention is to provide an improved method for preventing the overloading of turbine drivers driving compressors in a plurality of compression cycles. Yet another object of the present invention is to provide an improved method of preventing overloading of turbine drivers driving compressors in a plurality of compression cycles in the cryogenic cooling of gas. Another object of the present invention is to provide an improved method of preventing overloading of turbine drivers driving compressors in a plurality of compression cycles utilized to compress refrigerant and a portion of the feed gas in a cryogenic gas cooling process. A further object of the present invention is to provide an improved method for controlling the feed rate in a cryogenic gas cooling process. A still further object of the present invention is to provide an improved method for controlling the feed rate of a gas to a cryogenic gas cooling process and the speed of turbine drivers utilized to compress refrigerant and/or a portion of the gas. Yet another object of the present invention is to provide an improved method of controlling the feed rate of a gas to a cryogenic gas cooling process and thereby prevent overloading of turbine drivers utilized to drive compressors in a plurality of compression cycles utilized in the process. Another and further object of the present invention is to provide an improved method for controlling the feed rate of a gas to a cryogenic gas cooling process wherein operation of the turbine drivers driving compressors in a plurality of compression cycles in the process are prevented from overloading and the feed gas rate is maintained below a predetermined maximum. These and other objects of the present invention will be apparent from the following description.

Overloading of turbine drivers, due to changes in compressor limiting operating conditions, driving compressors in at least two compression cycles utilized in a process for cryogenically cooling a normally gaseous feed, is prevented by adjusting the flow rate of the normally gaseous feed in response to the highest one of the suction pressures of the low pressure stages of the compression cycles. In a further embodiment, the feed gas flow rate is also maintained below a predetermined maximum. In yet another embodiment, the speed of the turbine drivers is also controlled in response to the suction pressure to the low pressure stage of the compression cycle driven by the turbine driver in question.

BRIEF DESCRIPTION OF THE DRAWING

The single FIGURE of drawing is a simplified flow diagram of a cryogenic LNG production process incorporating a control system useful in the present invention.

DESCRIPTION OF THE PREFERRED EMBODIMENTS

While the present invention is applicable to prevention of overloading of a plurality of turbine drivers driving compressors for compressing refrigerants and/or a portion of a normally gaseous feed in a process for cryogenically cooling the normally gaseous feed, for purposes of simplicity and clarity, the following description will be confined to the cryogenic cooling of a natural gas stream to produce liquefied natural gas, since the problems associated with turbine driver overloading is common to all cryogenic gas cooling processes which utilize a plurality of compression cycles.

As previously pointed out in the introductory portion hereof, so long as the feed rate to a cyrogenic gas cooling process is maintained below a predetermined maximum, which maximum has been selected on the basis of efficient operation of the process and limitations of the equipment including the capacity of the compressors, and neither the character of the gas nor the process operating conditions change, the process will operate efficiently and within the limits of the equipment, particularly the turbine-compressor units. However, such normal and constant operations cannot be maintained at all times. For example, there are a number of compressor limiting operating conditions which fluctuate during the operation, such as changes in inlet gas composition, changes in climate that affect turbine horsepower, changes in boil-off rates resulting from ship loading to non-ship loading operations, shutdown of a turbine (either planned or unplanned), if more than one is utilized in parallel operation, changes in the operation of fractionation units or other units of equipment, etc. The effects of such changes or fluctuations on the operation of turbine-compressor units and resulting process dislocations are prevented in accordance with the present invention.

In accordance with the present invention it has been found that these problems can be overcome by controlling the rate of flow of the feed gas to a cryogenic process utilizing at least two compression cycles, and specifically by measuring the suction pressure of the low pressure gas to the compressors, deriving a desired feed flow rate in response to each of such measured suction pressures, selecting the lowest desired feed flow rate (which will be derived in response to the highest measured suction pressure if all set points are equal), and controlling the feed rate to the cryogenic process in response to such selected flow rate which will generally be control in response to the highest measured suction pressure. Preferably, the flow rate of the gas to the process is also controlled by maintaining the flow rate of the feed gas at the smaller of a predetermined maximum feed rate and the feed rate set by the previously mentioned highest suction pressure to the low stages of the compressors. While, as previously pointed out, some control to prevent overloading of the compressors can be obtained by controlling the speed of the turbine drivers, in accordance with suction pressure or pressures to the compressor or flow rates to and from the compressors, such control cannot compensate for all the problems involved and such individual control can cause upsets of the plant operation and reduce the efficiency and effectiveness of the process. However, in accordance with the present invention, such speed control can be advantageously utilized in combination with the control of the feed rate since operation in accordance with the present invention will prevent overloading of one of the compression cycles while the compression cycles which are not overloaded can operate under speed control.

The single FIGURE of the drawings is a simplified flow diagram showing a process for cryogenically producing liquefied natural gas which incorporates the method of control of the present invention.

Broadly, as depicted in the drawing, a natural gas feed which has been pretreated to remove acid gases and water and which is at an elevated pressure, for example, about 650 psia at approximately atmospheric temperature, is sequentially cooled by passage through a multistage propane cycle, a multistage ethane or ethylene cycle and a methane cycle, utilizing a portion of the feed gas as a source of methane, and finally cooling the feed gas stream in a multistage expansion cycle to further cool the same and reduce the pressure to essentially atmospheric pressure. Obviously, in the sequence of cooling cycles the refrigerant having the highest boiling point is utilized first followed by a refrigerant having an intermediate blowing point and finally by a refrigerant having the lowest boiling point.

A feed gas, as previously described, is introduced to the system through line 10. Gaseous propane is compressed in multistage compressor 12 driven by turbine driver 14. The compressed propane is passed through line 16 and cooled to liquefy the same as in cooler 18. The pressure of the liquefied propane is then reduced, as through throttle valve 20, to evaporate or flash a portion thereof, passed through high stage propane chiller 22 in indirect heat exchange with the natural gas feed and the flashed gas is returned to compressor 12 through line 24. This gas is at the highest pressure and hence the highest temperature of the gas returned to compressor 12 and therefore is fed to the high stage section of compressor 12. The remaining liquid propane is passed through line 26, the pressure further reduced by passage through throttle valve 28 and an additional portion of the liquefied propane is evaporated. This fluid stream is utilized to further cool the feed gas passing through line 30 in intermediate propane chiller 32. The thus evaporated portion of the propane refrigerant is separated and passed through line 36 to the intermediate stage of compressor 12. The remaining liquefied propane is passed through line 38 and the pressure is reduced through throttle valve 40 to evaporate the remainder of a liquefied propane. The feed gas passing through line 42 is cooled by this remaining portion of the propane refrigerant in low stage propane chiller 44. The propane refrigerant at its lowest pressure and consequently its lowest temperature is passed through line 46 to the low stage of compressor 12. As will be pointed out hereinafter it is the suction pressure through line 46 to the low pressure stage of compressor 12 which is utilized in the control method of the present invention.

It should be recognized at this point that the drawing depicts expansion of the propane refrigerant through throttle valves and separation of gas and liquid portions in the propane chillers. While this simplified scheme is workable and utilized in some cases, it is often more efficient and effective to carry out partial evaporation and separation steps in separate equipment, for example, combination of throttle valves and flash drums prior to passage into the propane chillers.

Following passage through the propane cycle the feed gas is passed through line 48 to the ethylene cycle. The cooling procedure in the ethylene cycle is substantially the same as that in the propane cycle except for the character of the refrigerant. Specifically, in the ethylene cycle gaseous ethylene is compressed in multistage compressor 50 driven by turbine driver 52. Compressed ethylene refrigerant is then passed through line 54 and is cooled in cooler 56 and condensed by exchange with high stage, intermediate stage and low stage propane. The liquefied ethylene is passed through throttle valve 58 to evaporate a portion thereof and consequently lower the temperature and thence to high stage ethylene chiller 60. In ethylene chiller 60 the feed gas through line 48 is passed in indirect heat exchange through the ethylene refrigerant. Evaporated or flashed ethylene gas is returned to the high stage of compressor 50 through line 62. The remaining ethylene is passed through line 64, expanded through throttle valve 66 and into intermediate stage ethylene chiller 68. In intermediate stage ethylene chiller 68 the feed gas passing through line 70 is passed in indirect heat exchange with the ethylene refrigerant. The evaporated ethylene refrigerant from chiller 68 is passed through line 72 to the intermediate stage of compressor 50. With respect to compressor 50, it is to be seen that, whereas compressor 12 was a single multistage compressor, compressor 50 has a separate high stage portion mechanically coupled to a combined intermediate and low stage unit. Consequently, the compressed ethylene from the intermediate stage of compressor 50 is passed through line 74 and combined with the high stage ethylene passing through line 62 to the high stage of compressor 50. The remaining liquid ethylene from chiller 68 is passed through line 76 and throttle valve 78 to evaporate the remaining portion of the ethylene refrigerant. The thus evaporated remainder of the ethylene refrigerant is passed through low stage ethylene feed gas chiller 80 in indirect heat exchange with feed gas stream passing through line 82. The evaporated ethylene refrigerant passes through line 84 to the low stage of ethylene compressor 50. As previously indicated with respect to the propane cycle, this low pressure-low temperature stream of gaseous ethylene to the low stage of the ethylene compressor is utilized for control purposes in accordance with the present invention. Generally in passing through low stage ethylene chiller 80 the feed gas is liquefied and the liquefied feed gas is passed through line 86.

Depending upon the nature of the feed gas and other factors the ethylene cycle can include four stages. In addition, as the feed gas sequentially passes through the propane cycle and the ethylene cycle, hydrocarbons having molecular weights higher than methane, i.e., $C_2+$ hydrocarbons, will condense from the feed gas stream. Consequently, in order to produce a pipeline gas from the feed gas, which is predominantly methane will small amounts of ethane, these condensed higher molecular weight hydrocarbons are separated from the feed gas stream. For this purpose, a natural gas liquids (NGL) separator will be disposed after each of the stages of the propane and ethylene cycles except for the last or last two stages of the ethylene cycle. The thus separated higher molecular weight hydrocarbons will then usually be passed to a fractionator or series of fractionators to separate the individual components thereof, namely, $C_2$, $C_3$, $C_4$ and $C_5+$. The $C_2$, $C_3$ and $C_4$ components can of course be utilized as feeds to a variety of chemical processes and $C_5+$ as a gaseous component. It should be noted at this juncture that the process described so far is basically a process for a separation of $C_2+$ hydrocarbons from a natural gas stream to recover the $C_2+$ components and produce a gaseous pipeline gas. For this purpose the feed gas would not be liquefied in low stage ethylene chiller 80 or this chiller would be eliminated from the system. As will be apparent hereinafter, the control method of the present invention can be applied to such a process since two compression cycles are involved. If the feed gas contains significant amounts of nitrogen the gaseous pipeline gas, or in the present case the liquefied feed gas, wuld normally be subjected to a nitrogen separation step, which can for example be a fractionation step or a plurality of expansion and separation stages. Such a separation step evaporates a portion of the methane containing most of the nitrogen from the remainder of the liquefied feed gas stream. This separated gas stream contains sufficient methane to be utilized as a low heating value fuel, usually within the cryogenic system itself. It is normally also utilized to further cool the feed gas stream in the third cooling stage prior to use as a fuel.

The liquefied feed gas from line 86 passes through methane economizer 88 where it is further cooled as hereinafter explained. From methane economizer 88 the liquefied gas passes through line 90 and its pressure is reduced by throttle valve 92, which of course evaporates or flashes a portion of the feed gas stream. The feed gas from line 90 is then passed to methane high stage flash drum 94 where it is separated into a gas phase discharged through line 96 and a liquid phase passing through line 98. The liquid phase passing through line 98 is also expanded through throttle valve 100 to further reduce the pressure and concomitantly evaporate a second portion thereof. The expanded fluids from line 98 are passed to interstage methane flash drum 102 where it is separated into a gas phase passing through line 104 and a liquid phase passing through line 106. The liquid phase is further reduced in pressure, to essentially atmospheric pressure, by passage through throttle valve 108. Again, a third portion of the liquefied gas is evaporated or flashed. The fluids from line 106 are passed to final or low stage flash drum 110. In flash drum 110, a vapor phase is separated and passed through line 112. The liquefied natural gas from flash drum 110 is passed through line 114 to storage unit 116. Obviously the flashed gases passing through lines 96, 104 and 112 are not only of reduced pressure but of reduced temperature, namely, a high pressure and high temperature in line 96, an intermediate pressure and temperature in line 104 and a low pressure and temperature in line 112. These cold vapor streams are then utilized to cool the feed gas in the methane cycle by passing the same in indirect heat exchange with the liquefied feed gas in methane economizer 88. A similar heat exchanger or heat exchangers or economizers may be utilized for example between the nitrogen removal step and the expansion cycle. In the third or methane cooling cycle the evaporated or flashed gases utilized for cooling in methane economizer 88 are compressed in methane compressor 118 driven by turbine driver 120 in the same manner as the compression of propane and ethylene refrigerants. Specifically, the high pressure, high temperature gas from line 96 is passed to the high stage methane compressor 118, the intermediate pressure and intermediate temperature gas from line 104 passes to the intermediate stage of compressor 118 and the low pressure, low temperature gas through line 112 is passed to the low stage methane compressor. Since the high, intermediate and low stages of compressor 118 are separate units which are mechanically coupled together the compressed gas from the low stage section passes through line 122 and is combined with the intermediate pressure gas in line 104 and the compressed gas from the intermediate stage of compressor 118 is passed through line 124 where it is combined with the high pressure gas through line 96 to the high pressure stage of compressor 118. The compressed gas is discharged from high stage methane compressor 118 through line 126, is cooled in cooler 128 and is further cooled in methane economizer 88. This cooled and compressed gas is then recycled to the feed gas stream. The recycled gas stream is preferably combined with the feed gas stream at a point at which the pressure and temperature of the recycled gas approximates the pressure and temperature of the main gas stream. Consequently, it will also be ahead of the last feed gas chiller which liquefies substantially all of the feed gas. The low pressure, low temperature flashed gas through line 112 can also have combined therewith vapors produced in LNG storage unit 116.

Before describing the control system in detail, it is first noted that the controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

In all cases, two signals are provided to a controller. One signal is generally referred to as the process variable signal (typically measured) and the other signal is referred to as the set point signal. Many set point signals are operator entered and, in general, these signals are not illustrated in the drawing for the sake of convenience. However, these signals will be described. Other set point signals are generated by control apparatus and these set point signals are illustrated in the drawing.

The rate of flow of natural gas feed to the system is measured and a signal proportional to the measurement is transmitted by flow transmitter 129 to flow recorder controller 130. Flow recorder controller 130 in turn transmits a signal to flow controller valve 132 as determined by the set point of flow recorder controller 130 and the flow of feed gas is thereby maintained as dictated by the set point. The suction pressures to the low stages of propane compressor 12, ethylene compressor 50 and methane compressor 118 are measured in lines 46, 84 and 112, respectively. In accordance with one embodiment of the present invention, pressure transmitters 134, 136 and 138 transmit signals, proportional to the pressures, to pressure recorder controllers 140, 142 and 144, respectively. Each of pressure recorder controllers 140, 142 and 144 is also provided with a set point signal (generally operator entered) which is representative of the minimum desired suction pressure for each of compressors 12, 50 and 118. In response to such set point signals and process variable signals, pressure recorder controllers 140, 142 and 144 provide three output signals 146, 148 and 150, respectively. Signals 146, 148 and 150 are scaled so as to be representative of the speed of the turbine drivers 14, 52 and 120, respectively, required to maintain the actual suction pressures substantially equal to the minimum desired suction pressures represented by the set points.

Pressure recorder controllers 140, 142 and 144 in turn transmit signals to speed controllers 146, 148 and 150. Speed controllers 146, 148 and 150 control the speeds of turbine drivers 14, 52 and 120, respectively, in response to the suction pressures in lines 14, 84 and 112 to the low stage compressors 12, 50 and 118, respectively. As previously indicated, when utilizing the primary control system of the present invention, such speed control of the turbine drivers is not necessary but is highly advantageous in combination with the control method of the present application.

Pressure transmitters 134, 136 and 138 also transmit a signal to pressure recorder controllers 152, 154 and 156, respectively. Pressure recorder controllers are also provided with set point (generally operator entered) representative of the maximum desired suction pressure for each of compressors 12, 50 and 118.

In response to the process variables and set points, each of pressure recorder controllers 152, 154 and 156 provide an output signal which is responsive to the difference between the process variable and set point compared by a particular controller. Each of these output signals is provided to the low select 158 and each of the output signals is scaled so as to be representative of the flow rate of the feed through conduit 10 required to prevent the maximum suction pressure from being exceeded for any particular compressor.

The output signal from pressure recorder controllers 152, 154 and 156, which is representative of the lowest flow rate (said signal will generally be derived in response to the highest measured suction pressure if all set points are equal) is selected by the low select 158 and provided to the low select 160 in a preferred embodiment. However, the signal selected by low select 158 could be provided directly to flow recorder controller 130 if desired.

The second signal provided to the low select 160 is an operator entered maximum feed gas flow rate for the plant. Use of such an operator entered signal allows the plant to run at either the maximum capacity as dictated by the output of low select 158 or at a maximum feed rate set by the operator, whichever is lower. The output signal from the low select 160 is provided as the set point signal to the flow recorder controller 130.

In response to the process variable and set point signal, the flow recorder controller 130 provides an output signal to the control valve 132 as previously described. Such output signal is responsive to the diffference between the process variable and set point signal and is scaled so as to be representative of the position of control valve 132 required to maintain the actual feed rate to the process substantially equal to the feed flow rate represented by the set point signal to the flow recorder controller 130.

While specific cryogenic methods, materials, items of equipment and control instruments are referred to herein, it is to be understood that such specific recitals are not to be considered limiting but are included by way of illustration and to set forth the best mode in accordance with the present invention.

That which is claimed is:

1. In a method for the cryogenic cooling of a normally gaseous feed which includes at least two compression cycles, each having at least a low pressure stage of compression and a turbine driver, and said compression cycles are adapted to compress a normally gaseous fluid selected from the group consisting of a refrigerant for cooling said normally gaseous feed and a portion of the normally gaseous feed, the improvement, comprising:

preventing overloading of said turbine drivers, due to changes in compressor limiting operating conditions, by:

(a) measuring the suction pressures to said low pressure stages of each of said compression cycles;

(b) establishing set point signals for each of said low pressure stages of each of said compression cycles, wherein said set point signals are representative of the maximum desired suction pressure;

(c) comparing the measured suction pressures and the set point suction pressures for the low pressure stages of each of said compression cycles and establishing control signals in response to such comparison, wherein each of said control signals is responsive to the difference between the particular suction pressure and the particular set point compared and wherein each of said control signals is representative of the flow rate of said normally gaseous feed required to prevent the actual suction pressure for any particular low pressure stage of each of said compression cycles from exceeding the set point suction pressure for that particular low pressure stage of each of said compression cycles;

(d) selecting the one of the thus generated control signals which is representative of the lowest flow rate of said normally gaseous feed; and (e) adjusting the flow rate of said normally gaseous feed in response to the selected control signal.

2. A method in accordance with claim 1 wherein the normally gaseous feed is a natural gas.

3. A method in accordance with claim 1 wherein the speed of each of the turbine drivers is also regulated in response to the suction pressure to the low pressure stage of the compressors driven by said turbine driver.

4. A method in accordance claim 1 wherein the normally gaseous feed is at an elevated pressure and the compression cycles include at least one refrigerant compression cycle adapted to compress a refrigerant for cooling said normally gaseous feed and a normally gaseous feed compression cycle adapted to compress a portion of the normally gaseous feed.

5. A method in accordance with claim 4 wherein the normally gaseous feed is cooled to a temperature sufficient to liquefy the same, the thus liquefied normally gaseous feed is further cooled by expanding the same in an expansion cycle, having at least a low pressure expansion stage, thus concomitantly evaporating a portion of said normally gaseous feed at said low pressure and the thus evaporated low pressure, normally gaseous feed is the portion of the normally gaseous feed thus compressed.

6. A method in accordance with claim 5 wherein the liquefied normally gaseous feed is expanded in the expansion cycle to at least three successively lower pressures, thus concomitantly evaporating high pressure, intermediate pressure and low pressure portions, respectively, of the normally gaseous feed and said low pressure, intermediate pressure and high pressure portions of said normally gaseous feed are compressed in a low pressure stage, an intermediate pressure stage and a high pressure stage of the normally gaseous feed compression cycle.

7. A method in accordance with claim 4 wherein the refrigerant is liquefied and the thus liquefied refrigerant is expanded to at least three successively lower pressures, thus concomitantly evaporating high pressure, intermediate pressure and low pressure refrigerant streams, respectively, and said low pressure, intermediate pressure and high pressure refrigerant streams are compressed in a low pressure stage, an intermediate pressure stage and a high pressure stage of the refrigerant compression cycle.

8. A method in accordance with claim 7 wherein the compression cycles include two like refrigerant compression cycles, utilizing two different refrigerants.

9. A method in accordance with claim 8 wherein the normally gaseous feed is a natural gas, one of the refrigerants is propane and the other of the refrigerants is selected from the group consisting of ethane and ethylene.

10. A method in accordance with claim 4 wherein the speed of each of the turbine drivers is also regulated in response to the suction pressure to the low pressure stage of the compressors driven by said turbine driver.

11. A method in accordance with claim 1 wherein the compression cycles include two like refrigerant compression cycles, utilizing two different refrigerants, the refrigerant from each refrigerant cycle is liquefied, the thus liquefied refrigerant is expanded to at least three successively lower pressures, thus concomitantly evaporating high pressure, intermediate pressure, and low pressure refrigerant streams, respectively, and said low pressure, intermediate pressure and low pressure streams are compressed in a low pressure stage, an intermediate pressure stage and a high pressure stage, respectively, of the refrigerant compression cycle.

12. A method in accordance with claim 11 wherein the normally gaseous feed is a natural gas, one of the refrigerants is propane and the other of the refrigerants is selected from the group consisting of ethane and ethylene.

13. A method in accordance with claim 11 wherein the speed of each of the turbine drivers is also regulated in response to the suction pressure to the low pressure stage of the compressors driven by said turbine drivers.

* * * * *